United States Patent [19]

Perisic

[11] 4,353,493

[45] Oct. 12, 1982

[54] ADVANCE MECHANISM

[76] Inventor: Zoran Perisic, Gwynfenton, White Well, St. Teath, Cornwall, England

[21] Appl. No.: 142,961

[22] Filed: Apr. 23, 1980

[30] Foreign Application Priority Data

Apr. 25, 1979 [GB] United Kingdom ..... 7914477

[51] Int. Cl.[3] ..... B65H 17/36

[52] U.S. Cl. ..... 226/158; 226/165

[58] Field of Search ..... 226/55-58, 226/120, 151, 158, 162, 165, 152, 154, 142-150

[56] References Cited

U.S. PATENT DOCUMENTS

| | | | |
|---|---|---|---|
| 1,851,400 | 3/1932 | Mitchell | 226/56 |
| 2,373,243 | 4/1945 | Grimson | 226/56 |
| 2,457,409 | 12/1948 | Shea | 226/56 |
| 2,506,649 | 5/1950 | Reeves | 226/56 |
| 4,040,553 | 8/1977 | Gotz | 226/151 |

FOREIGN PATENT DOCUMENTS

| | | | |
|---|---|---|---|
| 726356 | 3/1955 | United Kingdom | 226/154 |

*Primary Examiner*—Leonard D. Christian

*Attorney, Agent, or Firm*—Wegner, McCord, Wood & Dalton

[57] ABSTRACT

A film advance mechanism is provided in which film is advanced stepwise by two reciprocal film-engagement pins (20). The pins (20) are mounted on a cam follower (10) and the pins and cam follower are arranged to rotate relative to a circular cam (12). The surface profile of the cam (12) moves the pins (20) into engagement with the film during about 60° every revolution thereby allowing the film to be stationary for about 300°. Two reciprocal location pins (33) are also provided which are synchronized with the film-engagement pins and are arranged to engage the film only when the film is stationary.

11 Claims, 6 Drawing Figures

ADVANCE MECHANISM

This invention relates to a film advance mechanism.

At present a film advance mechanism comprises a pivoted advance arm which carries out a reciprocating to and fro motion in the desired path of movement of the film. The advance arm is associated with a cam which moves it into engagement with the film on its forward movement and leaves it free of the film on its return movement. Thus the exposure time of the film is determined by the return stroke of the advance arm.

In filming it can be an advantage to have as long as exposure or projection time as possible but, with the present system the only way of increasing this time is to increase the length of the advance arm and thereby the return stroke. However, the increase in size of the advance machanism makes this an impractical arrangement. Moreover, the fact that the advance arm carries out a reciprocating motion means that there is a tendency for an uneven transition between the forward and return strokes of the advance arm.

An object of the present invention is to provide an improved film advance mechanism.

According to the present invention there is provided a film advance mechanism for advancing film along a desired path comprising a rotatable advance member movable into the film path during a predetermined angular movement of the advance member so as in use to engage and advance the film.

Preferably the rotatable advance member is reciprocally movable from a retracted position out of the film path to an extended position in the film path in response to the changing surface profile of a cam. The advance member in the preferred arrangement comprises two reciprocal film-engaging pins connected to the cam follower all of which are rotatable relative to a circular cam. The cam may have two circular cam halves arranged to be adjustable relative to one another so that the effective surface profile of the cam can be changed.

The invention also includes a film mechanism comprising a film track along which film is arranged to be advanced, a rotatable film advance member adjacent the film track, means for moving the film advance member into engagement with the film during a part of the angular rotation of the film advance member so as to advance the film stepwise, and means for retracting the film advance member so that the advance member is disengaged from the film whereby the film is stationary during the other part of the angular movement of the film advance member.

According to another aspect of the invention there is provided a method of advancing film comprising the steps of locating the film on a film track, continuously rotating a film advance member at a constant angular velocity, moving the film advance member into engagement with the film, advancing the film along the film track through a predetermined angle of rotation of the film advance member per revolution thereof, and retracting the film advance member from engagement with the film so that in each revolution the film is stationary during the remainder of the angle of rotation of the film advance member.

The invention will now be described by way of example with references to the accompanying drawings in which.

Figure 2:
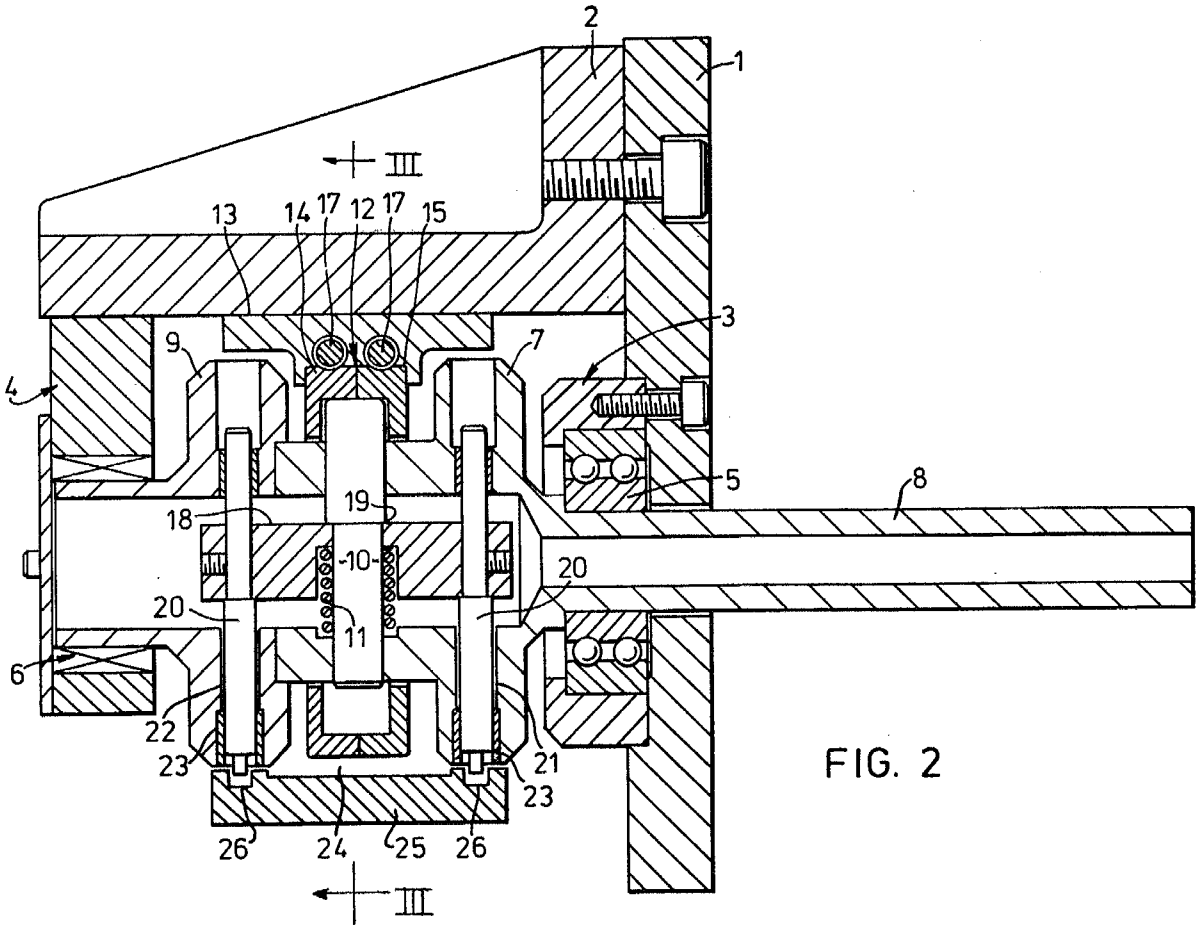
FIG. 2 is a section on II—II in FIG. 1.

In the drawings a film advance mechanism has a back plate 1 and an upper support plate 2. Secured to the back plate 1 and upper support plate 2 respectively are spaced inner and outer housings 3 and 4 which house bearing assemblies 5 and 6. The bearing assembly 5 supports for rotation an inner wheel member 7 connected to a drive shaft 8 and the bearing assembly 6 supports for rotation an outer wheel member 9. The inner and outer wheel members 7 and 9 are rotatable together about the axis of the drive shaft 8. The shaft 8 suitably has a flywheel 8' (omitted from FIG. 2 but shown in FIG. 6).

Figure 3:
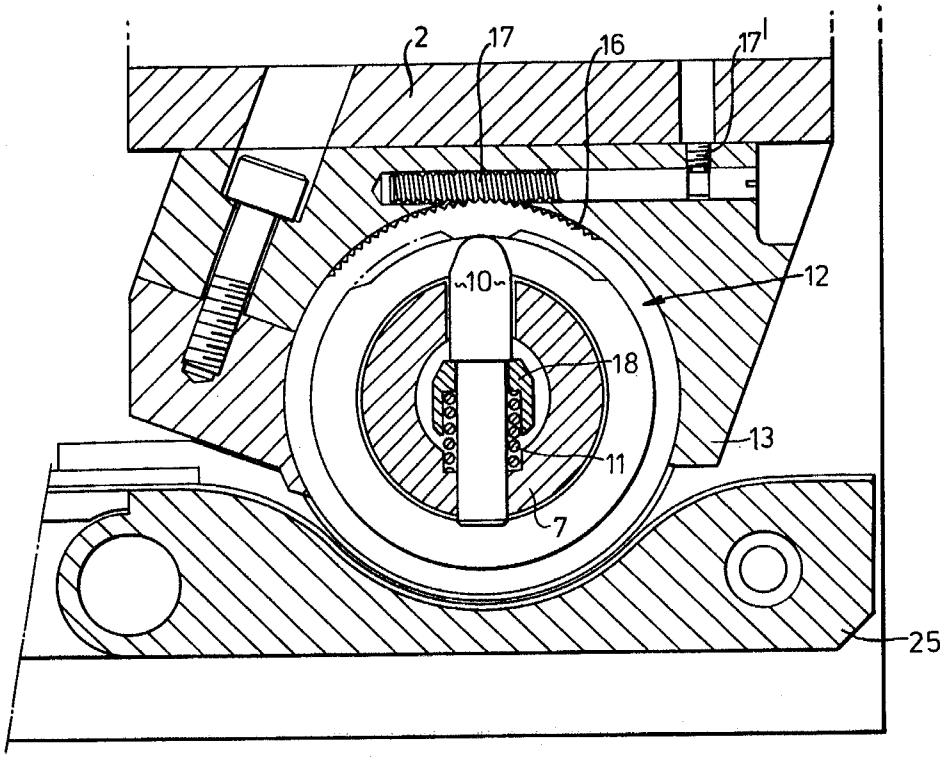
FIG. 3 is a section on III—III in FIG. 2.

The inner wheel member 7 has mounted therein a slidable cam follower 10 biassed by spring 11 into engagement with a circular cam element 12. The cam element 12 is mounted in a cam support 13 secured to the upper support plate 2 and consists of two circular halves, the extending cam half 14 and the retracting cam half 15. The two cam halves 14 and 15 have teeth 16 which mesh with respective adjusting screws 17 to provide rotational adjustment of the cam halves relative to one another and thereby alter the cam surface–see particularly FIG. 3. The adjusting screws 17 are locked in position by means of associated grub screws 17'.

The biassing spring 11 for the cam follower 10 acts between a seating in the inner wheel member 7 and a connecting cross member 18, slidably received on the cam follower 10 but normally biassed by the spring 11 against a shoulder 19 on the cam follower 10. The connecting cross member 18 is elongate and has at each end a bore in which is locked a film-engagement pin 20. The film-engagement pins 20 are slidably mounted in diametric bores 21 and 22 in the respective inner and outer wheel members 7 and 9. Thus, the pins 20, through the connecting cross member 18, are movable with the cam follower 10 and the film-engaging free ends of the pins 20, which are supported in bearing bushes 23, are therefore retracted and extended in response to the surface profile of the cam element 12.

Figure 4:
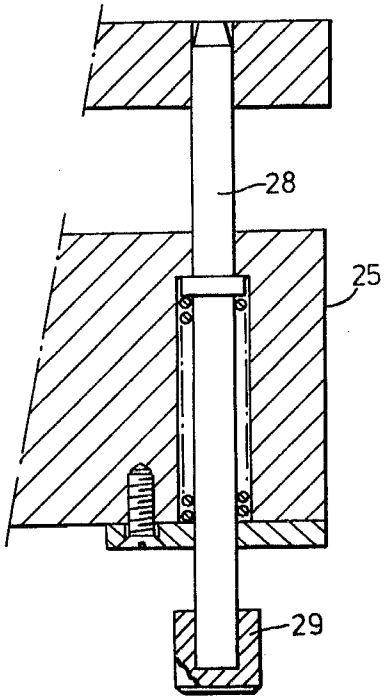
FIG. 4 is a section on IV—IV in FIG. 1.

The film (not shown) passes through a film path 24 and is held in position by a film track 25 hinged at 27 and which has longitudinal channels 26 which cooperate with the film engaging free ends of the pins 20 during the advance movement. The pins 20 engage with the holes provided along the side of the film. The film track 25 during use is held in place by a spring-biassed pin 28 which may be manipulated by knob 29 (FIG. 4).

Figure 1:
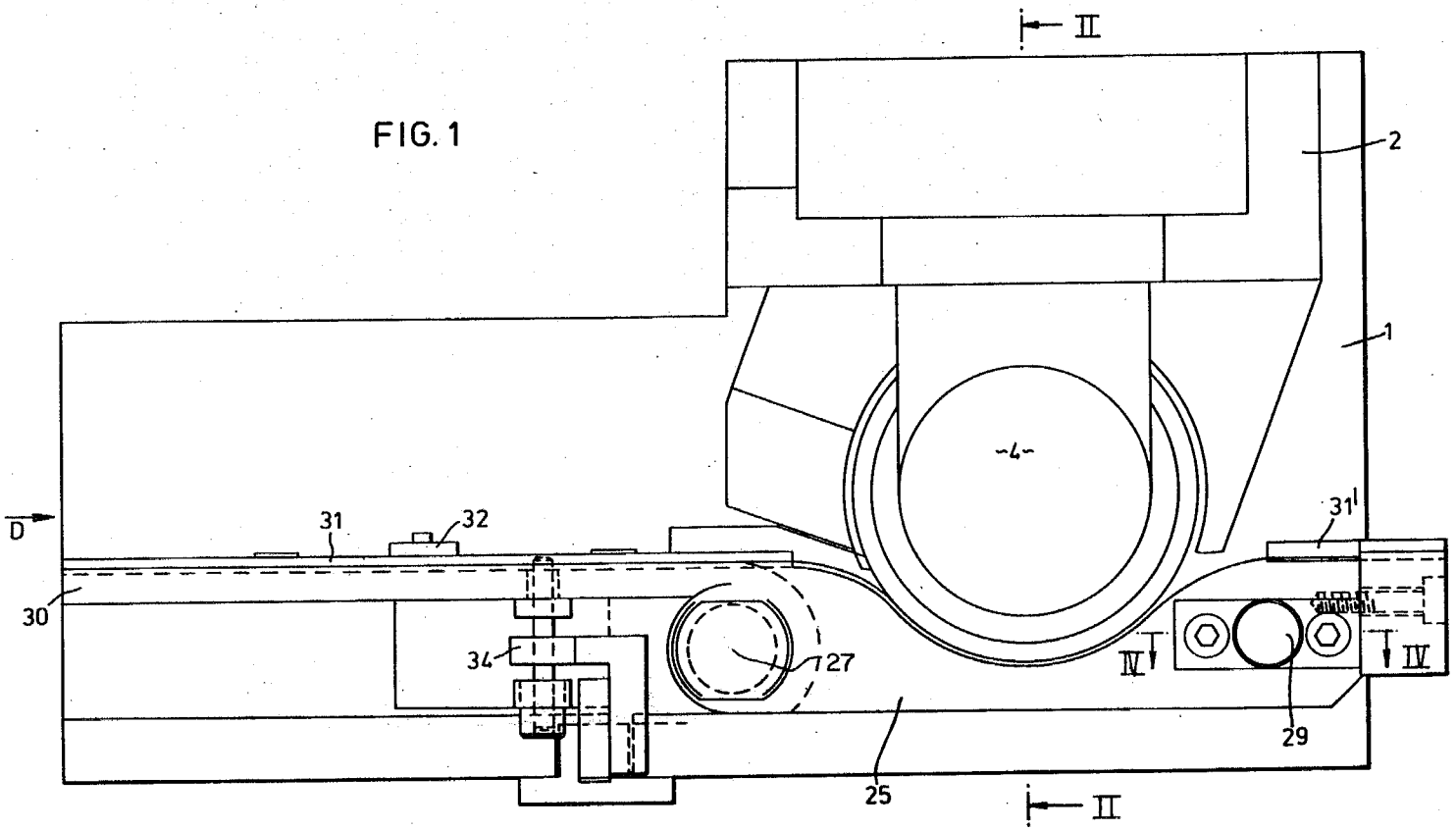
FIG. 1 is a plan view of the preferred embodiment of the present invention.
Figure 5:
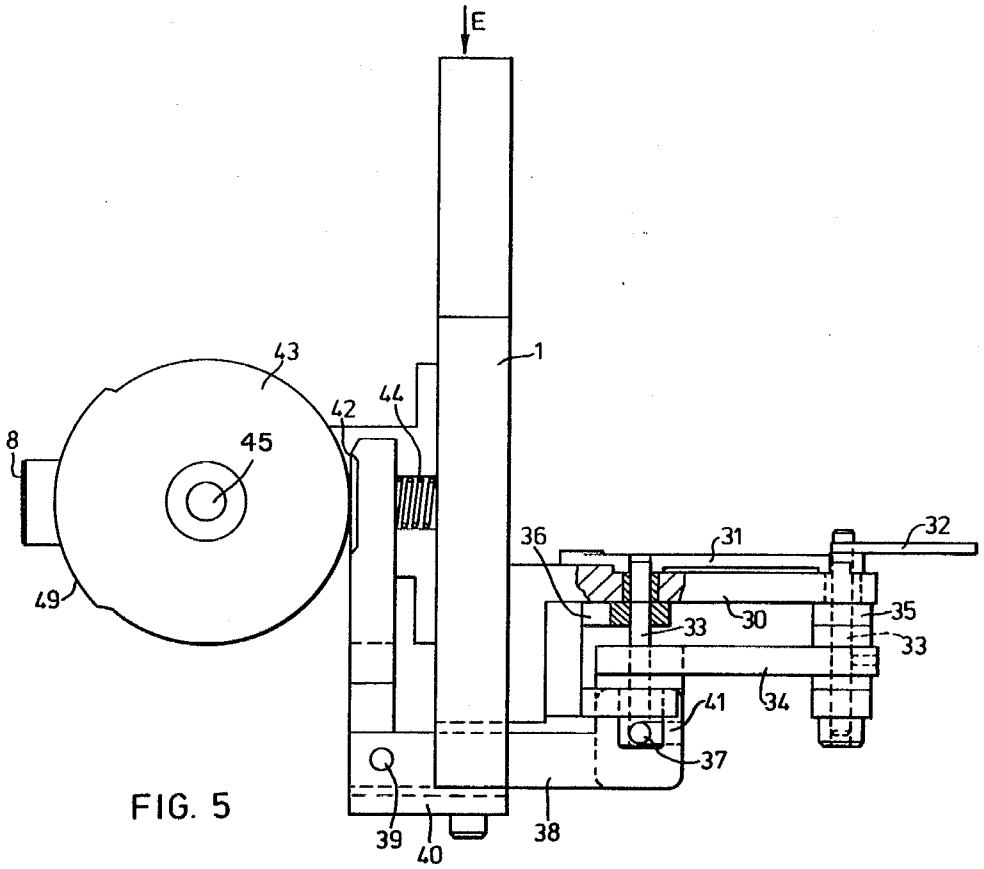
FIG. 5 is an end elevation in the direction of arrow D in FIG. 1 with the advance mechanism omitted for clarity.
Figure 6:
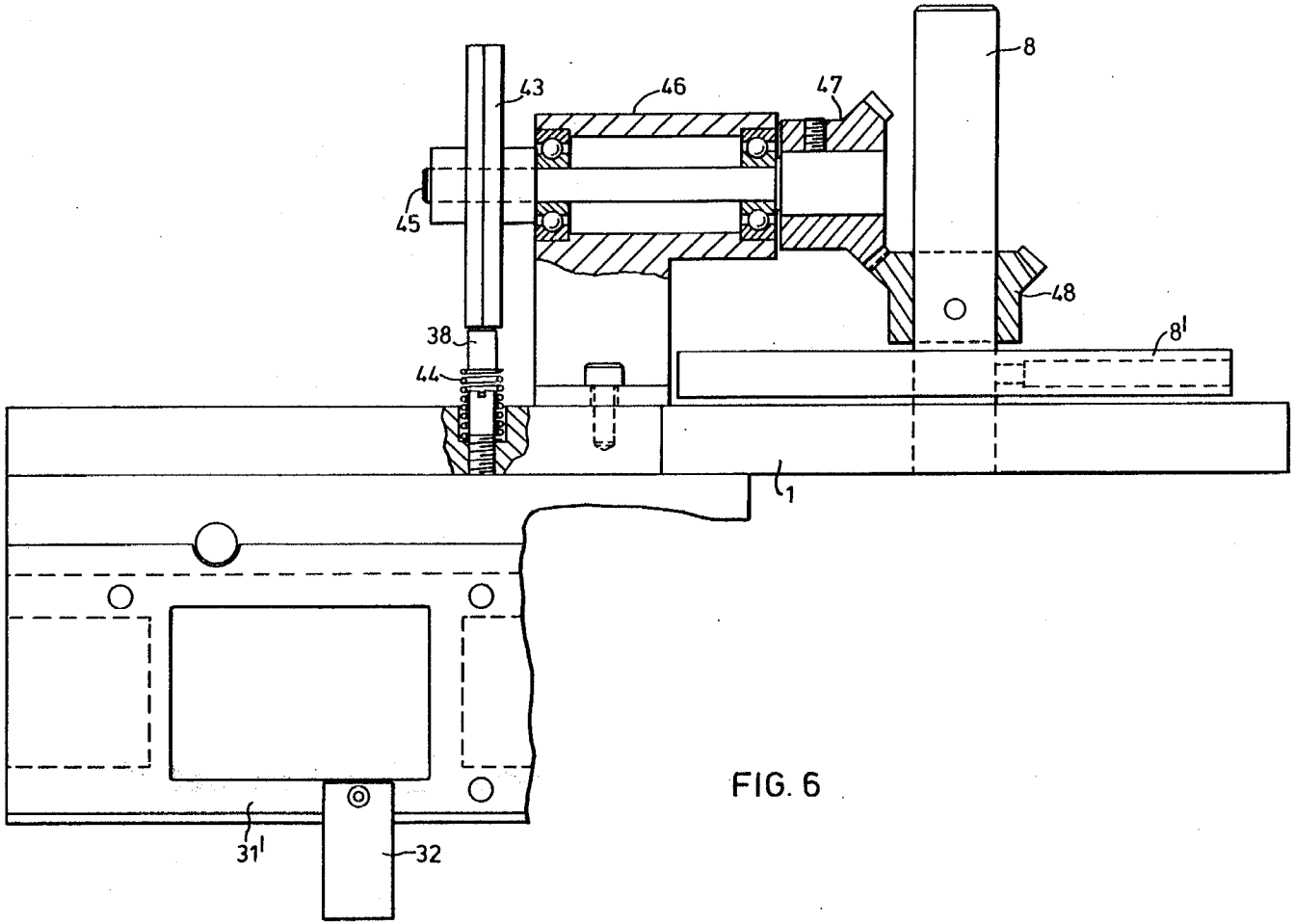
FIG. 6 is a view in the direction of arrow E on FIG. 5 with the pressure plate partially broken away.

Referring now particularly to FIGS. 1, 5 and 6 the film advance mechanism also includes a film locating mechanism for holding and locating the film when not being advanced. In FIG. 1 the film is advanced from left to right and is guided and held in position on a fixed track 30 by means of respective upstream and downstream pressure or dancing plates 31 and 31'. During loading, the upstream pressure or dancing plate 31 may be manipulated by means of lifting plate 32 so as to allow the film to be positioned on the fixed track 30.

Film location means associated with the fixed track 30 consists of front and rear location pins 33 mounted on a plate 34 and slidably received in respective front and rear guide bushes 35 and 36 (bush 35 has been omitted from FIG. 1 for clarity). The plate 34 has a depending portion provided with a protruding pin 37 which cooperates with a pivoted lever arm 38 so as to be movable in response to movement thereof. The lever arm 38 is L-shaped and is pivoted at 39 in a fixed lever block 40. The end of the lever arm 38 which cooperates with the pin 37 is slotted at 41 to form a lost motion connection and the other end has a an insert 42 of polytetrafluoroethylene (Teflon) which bears against a rotatable cam 43. The lever arm 38 is biased against the cam 43 by means of a spring 44. The cam 43 has a raised cam surface 49 and is mounted on one end of a shaft 45 which is rotatable in bearings 46. The other end of the shaft 45 has a bevel gear 47 which cooperates with a bevel gear 48 on the drive shaft 8 so that the film advance and locating mechanism are synchronised.

In use the film is set up so that the pins 20 engage the holes in the film (this will simultaneously ensure that location pins 33 are disengaged) and the film track 25 shut, the drive shaft 8 is then rotated so that the inner and outer wheel members 7 and 9 also rotate and, through gearing 47, 48, the cam 43 rotates. The rotation of members 7 and 9 also causes the cam follower 10, with the pins 20 carried thereby, to move relative to the surface profile of the cam element 12. As seen from FIG. 4 the profile of the cam element 12 is preferably adjusted so that the total pressure angle when the film-engaging pins 20 are extended is a maximum of about 60°. However, as will be understood, this angle can be varied as desired.

Thus, on constant rotation on the drive shaft 8, the cam follower 10 rotates causing the film-engagement pins 20 to advance the film during about a 60° angle of rotation; for the remaining 300° of rotation the film is stationary. During the same 60° angle the cam surface 49 causes the lever arm 38 to pivot about 39 disengaging the location pins 33 during advance; for the remaining 300° the location pins 33 are engaged.

The arrangement of the present invention enables the film to be stationary for a much greater time between advance steps without a bulky advance mechanism i.e. whereas the ratio of advance steps to when the film is stationary was previously 1:1 the ratio with the present invention may be greater than 1:3 and preferably about 1:6. Moreover, as the reciprocating to and fro motion is replaced in the present invention by a constant circular movement, the uneven transition at the end of the strokes on the know advance mechanism is no longer encountered.

I claim:

1. A film advance mechanism comprising:

a film path along which film is arranged to be advanced;

a film advance member;

means supporting said film advance member adjacent the film path for unidirectional rotation about an axis;

means operatively associated with said film advance member causing it to engage and advance the film along said path intermittently during said unidirectional rotation;

film location means;

and means for reciprocating the location means in timed relationship with the operation of the film advance member so that the location means engages the film when the film is not being advanced by the film advance member and disengages to free the film for advancement by the film advance member.

2. A film advance mechanism according to claim 1 wherein the film location means comprises two reciprocably mounted location pins, a rotatable cam with a profiled surface, means for rotating said cam in synchronism with the rotation of the film advance member, a cam follower for following the profiled surface of the rotatable cam, and means connecting the location pins and the cam follower whereby movement of the cam follower effects reciprocal movement of the location pins.

3. A film advance mechanism comprising:

a film path along which film is arranged to be advanced;

a film advance member comprising wheel means mounted adjacent said film path for unidirectional rotation about an axis, a cam follower movably mounted on said wheel means, and two film engaging pins mounted on the wheel means for reciprocation in response to movement of said cam follower;

and a cam adjacent the wheel means, said cam having a profiled surface upon which the cam follower bears so rotation of the wheel means causes movement of the cam follower and resultant reciprocation of the film engaging pins into and out of engagement with the film so as to advance said film along the film path intermittently during said unidirectional rotation of the wheel means.

4. A film advance mechanism according to claim 3 wherein the cam comprises two circular cam halves with profiled surfaces, and wherein means are provided for rotatably adjusting the cam halves relative to one another to change the effective surface profile of the cam and thereby change the relative periods of retraction and extension of the film engaging pins.

5. A film advance mechanism comprising:

a film track along which film is arranged to be advanced;

a film advance member;

means supporting said film advance member adjacent the film track for unidirectional rotation about an axis;

means for moving the film advance member into engagement with the film so as to advance the film during a part of each revolution of the film advance member;

and means for moving the film advance member to disengage it from the film during the rest of each revolution, whereby the film is intermittently advanced by a predetermined increment during each revolution.

6. A film advance mechanism according to claim 5 wherein the film track includes a curved portion concentric with an arc of rotation described by the film advance member.

7. A film advance mechanism according to claim 5 or 6 wherein the ratio of the time the film is in advance movement to the time the film is stationary is greater than 1:3.

8. A film advance mechanism according to claim 7 wherein the ratio is approximately 1:6.

9. A film advance mechanism comprising:

a film path along which film is arranged to be advanced;

a film advance member;

means supporting said film advance member adjacent the film path for unidirectional rotation about an axis;

and means operatively associated with said film advance member for reciprocating the film advance member from a retracted position out of the film path to an extended position in the film path so as to engage and advance the film along said path intermittently during said unidirectional rotation, said last named means comprising a cam consisting of two circular cam halves with profiled surfaces which effect said reciprocation of the film advance member, and means for rotatably adjusting the cam halves relative to one another to change the effective surface profile of the cam and thereby change the relative periods of retraction and extension of the film advance member.

10. A film advance mechanism according to any one of claim 4, 8 or 9 including a film locating mechanism comprising film location means, and means for reciprocating the location means in timed relationship with the operation of the film advance member so that the location means engages the film when the film is not being advanced by the film advance member and disengages to free the film for advancement by the film advance member.

11. A film advance mechanism according to claim 10 wherein the film location means comprises two reciprocably mounted location pins, a rotatable cam with a profiled surface, means for rotating said cam in synchronism with the rotation of the film advance member, a cam follower for following the profiled surface of the rotatable cam, and means connecting the location pins and the cam follower whereby movement of the cam follower effects reciprocal movement of the location pins.

* * * * *